United States Patent [19]

O'Donnell

[11] 4,170,839

[45] Oct. 16, 1979

[54] CHILD'S TOY IN THE FORM OF A MINIATURE STORM SEWER SYSTEM

[76] Inventor: Robert J. O'Donnell, 15 Greely St., Hudson, N.H. 03051

[21] Appl. No.: 865,909

[22] Filed: Dec. 30, 1977

[51] Int. Cl.[2] ..... A63H 33/10

[52] U.S. Cl. ..... 46/17; 35/16

[58] Field of Search ..... 35/16; 46/1 R, 17, 27–29

[56] References Cited

U.S. PATENT DOCUMENTS

| | | | |
|---|---|---|---|
| 2,284,458 | 5/1942 | Van Antwerp | 35/16 |
| 2,958,142 | 11/1960 | Kershaw et al. | 35/16 |

*Primary Examiner*—Louis G. Mancene
*Assistant Examiner*—Robert F. Cutting

[57] ABSTRACT

A child's toy in the form of a miniature, operative storm sewer system.

19 Claims, 4 Drawing Figures

CHILD'S TOY IN THE FORM OF A MINIATURE STORM SEWER SYSTEM

FIELD OF THE INVENTION

The invention relates to realistic toys which entertain and educate children.

BACKGROUND OF THE INVENTION

Realistic toys sometimes closely resemble the configurations of real machines or systems. But those that do, do not always operate. Model airplanes are an example. Those that operate, such as train sets, do not always operate on the same principles as the real machine or system.

Educational toys sometimes slavishly imitate real machines or systems, directing the child in such particularized detail that imagination is superfluous. Toy models of the human anatomy are an example. Other educational toys, such as erector sets, give free reign to the child's imagination, allowing him to construct totally fanicful devices; however they provide but little direction or guidance.

SUMMARY OF THE INVENTION

I have realized that a miniature, workable storm sewer system can serve as a new child's toy, offering many advantages. It replicates in miniature a real sewer system. It operates on the same principles as a real sewer system. It affords the child considerable freedom in layout and use, yet confines him within the principles on which a real storm sewer system operates. It can be enjoyed in conjunction with other toys, particularly earthmoving toys. It can be enjoyed indoors and out. It gives to the child an appreciation for man's place in his environment and an elementary understanding of a number of the laws of physics.

In its preferred embodiment, the present invention comprises a set of interconnectable miniature pipes, manholes, and couplings, together with a miniature trench box, ladder, lifting bar, and crew of toy construction workers. It also includes a hose connector, construction plans, and a compartmentalized storage container.

Pipes, joined to each other by close-fitting couplings and fitted into manholes, are laid out by the child in a realistic storm sewer system in trenches dug either in a sandbox or in soil. A hose, connecting the system to a water source, e.g. the garden hose available in most homes, carries water to the system. The trenches may be filled in, leaving only the manhole covers exposed, as with real storm sewer systems. But if left exposed, transparent pipes give the child opportunity to view and experiment with water flow.

Other objects, features, and advantages of the invention will be apparent during the course of the following description.

DESCRIPTION OF THE PREFERRED EMBODIMENT

The structure, manufacture, and operation of the preferred embodiment of the invention are explained in connection with the following drawings.

DRAWINGS

DESCRIPTION

Figure 1:
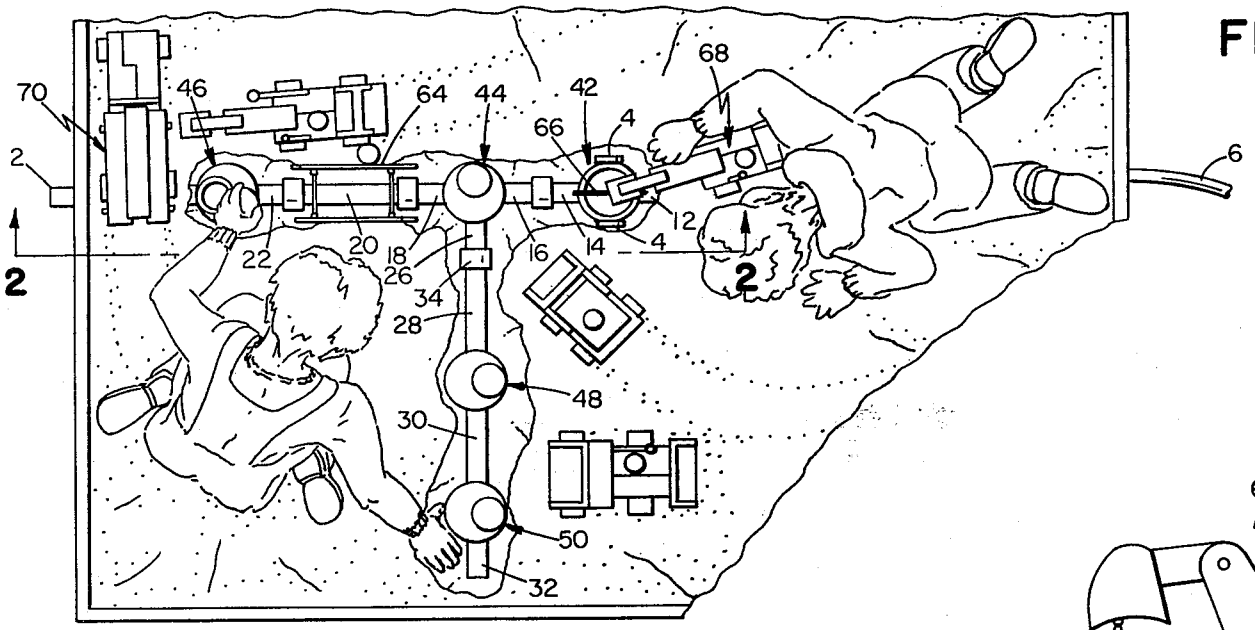
FIG. 1 is a bird's eye plan view of a storm sewer system embodying the invention in use.
Figure 2:
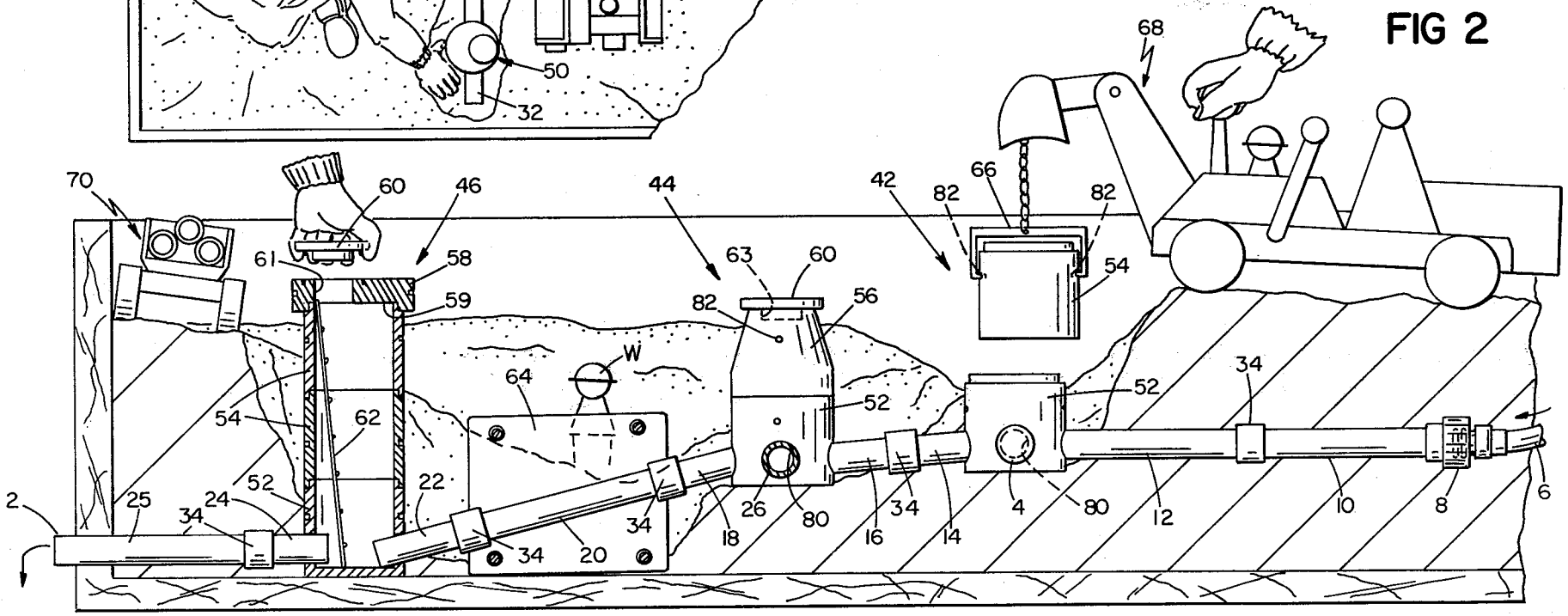
FIG. 2 is a partially cross-sectional elevational view of the system of FIG. 1.

In FIGS. 1 and 2 of the preferred embodiment, the system is shown assembled and connected to a garden hose 6 carrying water from an outside source by a threaded connector 8 at one end of the pipe 10. Pipe 10 and pipes 12 through 32 provide a course for the flow of water. The pipes are of six inch and three inch length, 1 inch diameter, and are made of a tough, resilient synthetic resinous material such as polyvinyl chloride or rubber. In the illustrated embodiment, the pipes are of transparent plastic, so that a child can view the system's operation.

The adjacent ends of some of the pairs of pipes, e.g., pairs 10 and 12; 14 and 16; 20 and 22; 24 and 25; and 26 and 28 are joined by short cylindrical couplings, 34, also made of a resilient substance that is tough, inexpensive and in the preferred embodiment, transparent. Each coupling is about 1 inch long, and its inner diameter is such that it will form a close watertight slip fit with the outer diameter of the pair of pipe ends slipped into the coupling.

The illustrated system also includes a number of manhole assemblies, located along the course of the pipes at the child's discretion. FIGS. 1 and 2 illustrate five manhole assemblies, designated 42, 44, 46, 48 and 50 respectively. These are made up, as shown in FIG. 2, by various manhole components: cylindrical base 52, tubular riser 54, top cone 56, top slab 58, and cover 60.

The bases 52 are cup-like, having integral bottoms, with the side walls pierced by pipe-receiving holes numbering from one up to four.

Any manhole assembly may include one or more risers 54, on top of the bases, as required by the overall height of the particular manhole assembly. At the top is placed top cone 56 and cover 60, or a flat slab 58 is placed directly on a base or upon a riser and receives a cover 60.

Each cylindrical base 52 is three inches in diameter, of 3/16 inch wall thickness and defines, at its top, a circumferential lip 51 projecting upwardly from its inner cylindrical surface to tightly interfit with the matching lip 55 of riser 54 or of lip 57 of cone 56.

Risers 54 comprise three inch diameter cylinders, similarly having a wall thickness of 3/16 inch, the cylindrical lips 53, 55 projecting, respectively, upwardly from the inner cylindrical surface of its top and downwardly from the outer cylindrical surface of its bottom.

Cones 56 have the same wall thickness, a diameter of three inches at their bottom, and are about one and one half inches in diameter at their top. The conical surface portion of each is such that one side of the unit is parallel to the manhole axis, to receive a ladder 62. The bottom of each cone includes a circumferential lip 57 projecting downwardly from its outer cylindrical surface of size to interfit with the lip 51 of a base 52 or, the lip 53 of a riser 54. The top defines an opening 63 for cover 60. Each slab 58 includes a recess 59 in its bottom arranged to engage the top of a base or riser, and a through off-axis hole 61, is provided for the cover.

As previously mentioned, each manhole base 52 includes one or more circumferentially spaced, horizontally extending holes 80 in its cylindrical side wall for receiving the end of a pipe (or of a blind-ended pipe-like stub cap 4, for sealing). As shown, the bases 52 of manhole assemblies 46, 48 and 50 each include two diametrically opposed holes 80; the base 52 of manhole assembly 44 includes three holes 80 spaced at 90° intervals; and the base 52 of manhole assembly 42 has four holes, two being plugged by stub caps 4. Each hole 80 has an inner diameter equal to or slightly less than the outer diameter of one of pipes 10 through 32 so that, when the pipe end is fitted within the hole, the pipe and hole will form a watertight seal. The resilience of the pipes and manhole bases is such that the desired watertight seal with be provided even if the pipes are skewed rather than aligned with the hole.

The interconnection of the pipes and manhole assemblies is clearly shown in the cross-sectional view of FIG. 2, which illustrates also how water will flow into and out of the system.

To permit the various parts of the manhole assemblies to be lifted and placed, a pair of diametrically opposed lifter holes 82 are provided in the outer surface of each of bases 52, risers 54, cones 56 and slabs 58; and the system includes a miniature lifter bar 66 which inludes a lifting chain 69, and a pair of downwardly projecting arms 71 having inner projecting lugs 73 sized and spaced to snap into lifter holes 82.

Other accessories add further realism to the system. Ladder 62 leads down into manhole 46, allowing simulated construction workers W to descend and make repairs. Trench box 64 prevents a cave-in while pipe 20 is being laid or repaired.

FIGS. 1 and 2 show other toys 68 and 70 being used in conjunction with the present invention.

Figure 3:
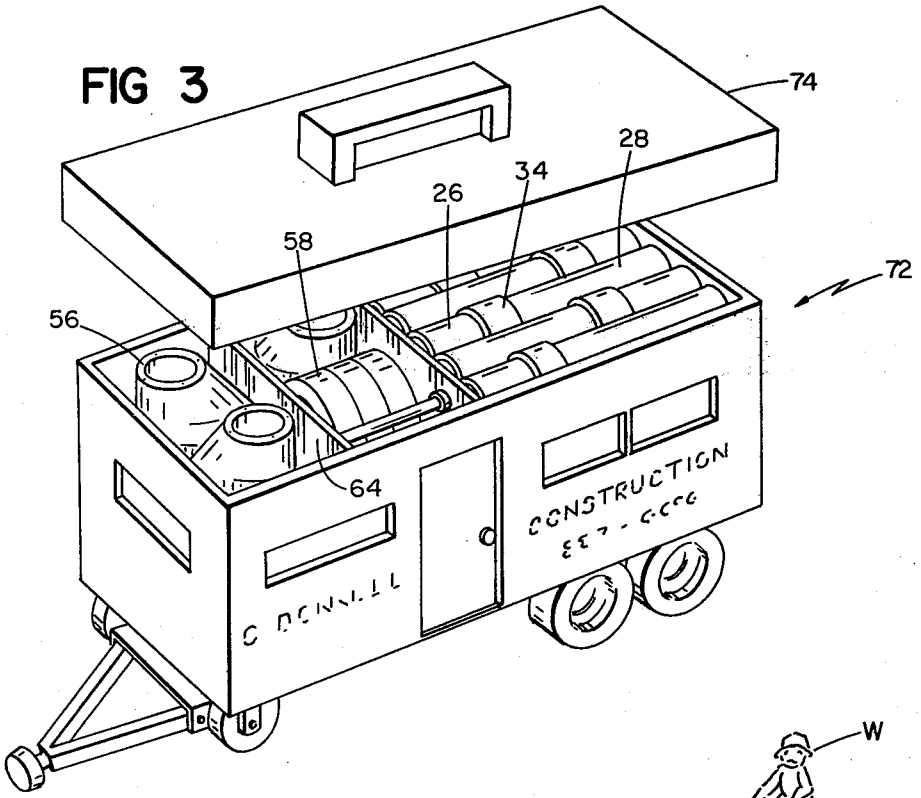
FIG. 3 is a view of the parts of the system stored in a container in the form of a compartmentalized field office trailer.

FIG. 3 shows pipes, couplings, and manhole components in compartmentalized field office trailer 72, open at its top and having a roof cover 74. The pieces fit together for easy, compact storage.

MANUFACTURE

Manufacturing techniques known in the art are used. The pipes are constructed as extrusions of a clear plastic or other resilient synthetic resinous material to allow visual appreciation of the system's operation.

All other components of the system comprise moldings of polyvinyl chloride or similar materials.

OPERATION

Water flows into the system from an outside source, e.g. a garden hose 6, at threaded connector 8, and exits through discharge outlet 2 at the end of pipe 25. The network of pipes 10, 12, 14, 16, 18, 20, 21, 26, 28, 30 and 32 send flow through manholes 42, 44, 46, 48 and 50. In laying the pipes in a sandbox, or in making repairs, the child can use trenchbox 64 to prevent cave-ins, to enable the child's arm access to the work site as well as to protect toy workers.

The child enjoys considerable freedom in laying out the system. He can arrange the pipes in different directions and depths; he can vary the height of manholes by adding manhole risers; he can fill in the trenches or leave the pipes exposed, permitting visual appreciation of the operation; and in all of this, he can observe the results of his planning and can correct the design to ensure continuity of gravity flow throughout the system.

Figure 4:
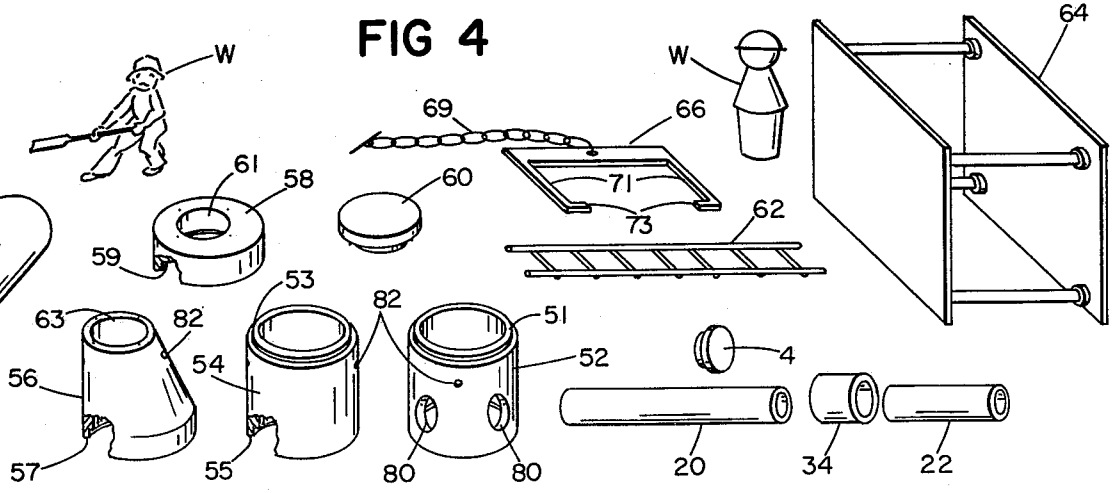
FIG. 4 is a view of parts ready for use.

Water flowing through the system rises in the manholes, if the system is charged in excess. By controlling the intake of water, the child controls the level of water in the pipes and in the manholes. To simulate construction of manhole assemblies, the child first digs a hole and then lifts and lowers manhole components, one by one, by using lifting bar 66, which holds the components by the lifting holes 82 (see FIG. 4). The child can use other toys, such as the illustrated bulldozer, in conjunction with the system, both for digging the trenches and holes and for lifting and lowering the pieces.

To simulate repairs, the child removes manhole cover 60 permitting toy construction workers to descend ladder 62 into the manhole. The ladder lens against the vertical wall of a manhole riser 54 or cone 56.

When play is done, the child stores the pieces in contrainer 72 (see FIG. 3), which is in the form of a compartmentalized field office trailer. The sewer system is suitable for play in a sandbox indoors or in soil outdoors.

Other Embodiments

The sewer system laid out in FIGS. 1 and 2 is merely suggestive of many possible arrangements. Increasing the number of pieces increases the variety of possible arrangements. Other miniaturized elements may be added to the invention to grant the child's imagination even wider play. Such elements might include toy water tanks, mortar buckets, surveying lasers, and blasting boxes.

What is claimed is:

1. A child's toy in the form of a miniature storm sewer system set and comprising:

a plurality of pipes about one inch in diameter;

connector means sized and adapted to engage and connect together the adjacent ends of a pair of said pipes; and a plurality of simulated manholes each including in the side wall thereof spaced water passage holes each of which is sized and adapted to be connected to a said pipe.

2. The child's toy of claim 1 wherein said pipes comprise extrusions of resilient synthetic resinous material adapted to enable the child to readily fit the pipes into the manholes.

3. The child's toy of claim 1 wherein said manholes comprise cup-like bases molded of resilient synthetic resinous material, the bases having resilient side walls adapted to receive pipes being inserted by the child.

4. The child's toy of claim 1 wherein each of said connectors includes a cylindrical surface adapted to engage and form a watertight fit with a cylindrical surface adapted to engage an end portion of a said pipe, and the interior of each of said holes in the side wall of a manhole is adapted to engage and form a watertight fit with the outer surface of a said pipe.

5. The child's toy of claim 1 wherein a said pipe includes a threaded connector for connecting the sewer system to a hose from an outside water supply.

6. The child's toy of claim 1 wherein said manholes include stackable, interlocking manhole bases and upper members.

7. The child's toy of claim 1 wherein said pipes are of a transparent substance, permitting visual application of the storm sewer system's operation.

8. The child's toy of claim 1 wherein said manholes are at least in part transparent, permitting visual appreciation of the storm sewer system's operation.

9. The child's toy of claim 1 including a miniature trench box comprising two parallel panels joined by four connecting braces and arranged to be placed about a said pipe to prevent cave-in around said pipe while it is being laid or repaired.

10. The child's toy of claim 1 wherein each of said manholes include a lower portion in the form of a cylinder closed at its bottom and the cylindrical surface of which defines said water passage holes, and an upper portion which is shaped to interfit with the top of the base portion.

11. The child's toy of claim 10 wherein interfitting segments of the upper and lower portions comprise overlapping circumferential lips.

12. The child's toy of claim 10 wherein the upper portion is in part a cone and has a smaller diameter at its top than at its bottom.

13. The child's toy of claim 10 including a slab having a hole extending therethrough, arranged to receive and tightly engage the top of base.

14. The child's toy of claim 10 wherein the outer surfaces of said upper and lower portions of said manhole define respective pairs of diametrically opposed recesses for engaging projections on a toy lifter.

15. The child's toy of claim 1 wherein the maximum diameter of each said manhole assemblies is about three times that of a said pipe.

16. The child's toy of claim 1 including a toy storage box adapted to receive and store said set and said box carrying indicia simulating a construction field office.

17. The child's toy of claim 1 including caps adapted to engage and seal selected ones of said water passage holes.

18. The child's toy of claim 1 wherein said pipes, manholes and connectors are all of resilient synthetic resinous material.

19. The child's toy of claim 1 wherein selected ones of said manholes include two to four water passage holes spaced at intervals of 90° or 180°.

* * * * *

UNITED STATES PATENT AND TRADEMARK OFFICE

CERTIFICATE OF CORRECTION

PATENT NO. : 4,170,839

DATED : October 16, 1979

INVENTOR(S) : Robert J. O'Donnell

It is certified that error appears in the above-identified patent and that said Letters Patent are hereby corrected as shown below:

Column 3 - Line 13 "with be" should be --will be--.

Column 4 - Line 12 "lens" should be --leans--.

Column 4 - Line 62 "application" should be --appreciation--.

Signed and Sealed this

*Eighth* Day of *January 1980*

[SEAL]

*Attest:*

SIDNEY A. DIAMOND

*Attesting Officer*

*Commissioner of Patents and Trademarks*